United States Patent [19]

Berkowitz et al.

[11] 4,028,709

[45] June 7, 1977

[54] ADJUSTABLE YAGI ANTENNA

[75] Inventors: Benjamin Berkowitz, Baltimore, Md.; Arthur Luedtke, Marietta, Ga.; William L. Kilpatrick, Austell, Ga.; William F. Bentley, Jr., Smyrna, Ga.

[73] Assignee: The United States of America as represented by the Field Operations Bureau of the Federal Communications Commission, Washington, D.C.

[22] Filed: Sept. 10, 1975

[21] Appl. No.: 611,938

[52] U.S. Cl. ..... 343/819; 343/823; 343/894

[51] Int. Cl.[2] ..... H01Q 19/30

[58] Field of Search ..... 343/819, 823, 894, 761, 343/818, 839, 915

[56] References Cited

UNITED STATES PATENTS

| | | | |
|---|---|---|---|
| 2,492,989 | 1/1950 | Halstead | 343/823 |
| 2,512,725 | 6/1950 | Mock | 343/880 |
| 2,673,295 | 3/1954 | Wentworth | 343/818 |
| 2,861,267 | 11/1958 | Arrasmith | 343/823 |
| 3,383,694 | 5/1968 | Strohmeyer | 343/839 |
| 3,821,742 | 6/1974 | Pollard | 343/819 |

*Primary Examiner*—Eli Lieberman
*Attorney, Agent, or Firm*—Wm. Ferrel Bentley

[57] ABSTRACT

A yagi antenna having a director element, a half-wave active dipole element, and a reflector element mounted on an antenna boom. All antenna elements are rods that are telescopically adjustable in length from a collapsible position to an operating length for a predetermined frequency of operation, and removable from threaded mounting for storage. The director element and reflector element are slidably adjustable on the antenna boom for independent spacing with respect to the half-wave active dipole element. The antenna boom has two mast support holes; one for horizontal polarization and the other for vertical polarization. A ferrite core member surrounds a coaxial cable connecting the half-wave active dipole element to a coaxial connector, and provides balun action between the coaxial cable and a balanced antenna feed point.

2 Claims, 9 Drawing Figures

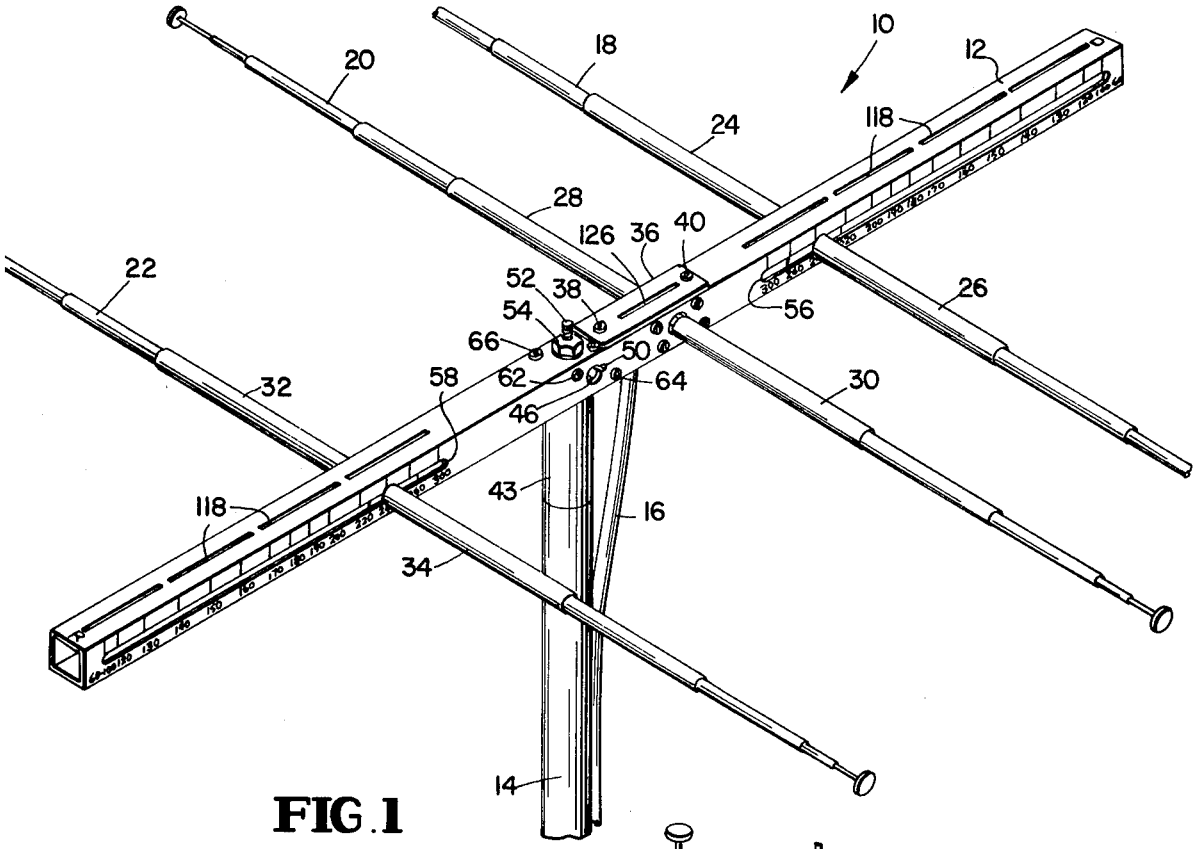
FIG. 1
FIG. 2
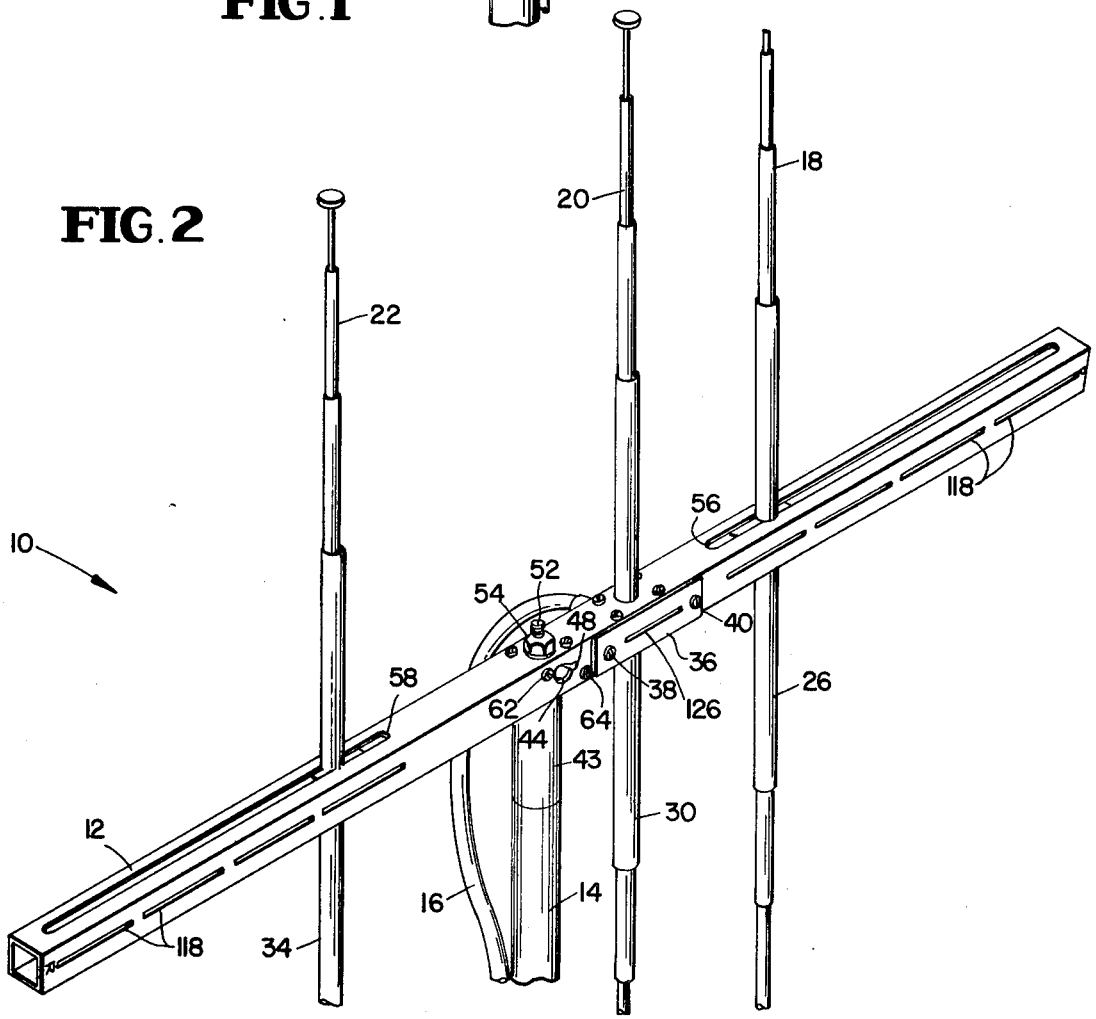

MEGACYCLES
400
350
300

ADJUSTABLE YAGI ANTENNA

BACKGROUND OF THE INVENTION

1. Field of the Invention

The present invention relates generally to improvements in a yagi antenna, and more particularly pertain to new and improved adjustable antenna elements wherein the length of each antenna element rod is telescopicly adjustable in length from a collapsible position to an operating length for a predetermined frequency of operation. The spacing between the director element and reflector element is slidably adjustable on the antenna boom for independent spacing with respect to the half-wave active dipole element. The antenna boom has two mast support holes for mounting the antenna for either horizontal or vertical polarization.

2. Description of the Prior Art

In the field of yagi antennas, it has been the general practice to employ antennas with mechanically fixed antenna elements, nonadjustable element rods, mechanically fixed element spacing, and a single mast mounting hole. Such an antenna has been unsatisfactory in that the center frequency and polarization of the antenna is mechanically fixed when the antenna is mounted for installation. Adjustment of either the center frequency of the antenna and/or the polarization is impracticable if at all possible. This is due to the mechanical mounting of the elements onto the antenna boom and the securing of the antenna boom to the supporting mast. The antenna when assembled and mounted, has usually been manufactured and cut to a center frequency, and is not shiftable from that frequency as the elements are a fixed length. Further, the antenna elements are not removable from the antenna boom for the purposes of storage or transporting the antenna from one location to another. The prior art is illustrated by the U.S. Pat. issued to Wentworth, No. 2,673,295, which shows a foldable two element in FIG. 1 that is used for over a limited frequency range.

SUMMARY

The general purpose of this invention is a yagi antenna with adjustable antenna element rods that telescope from a collapsible position to a predetermined operating length for a particular frequency of operation. An object of the present invention is the utilization of a single director element, a half-wave active dipole element, and a single reflector element mounted on an antenna boom. Another object is to provide antenna element rods which are adjustable in length from a collapsible position to a predetermined operating length for a particular frequency of operation. A still further object of the invention is to provide antenna element rods which are easily removed from threaded rods on the antenna boom. A further object of the invention is to provide a director element and a reflector element which are adjustable in a space relationship along the antenna boom with respect to the half-wave active dipole element. Still another object is to provide for optimization of nominal impedance matching, gain, bandwidth, front to back ratio, and directional pattern of the antenna. A still further object is the provision of two mast mounting holes in the antenna boom for either horizontal or vertical polarization.

BRIEF DESCRIPTION OF THE DRAWING

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

FIG. 1 is a perspective view of a yagi antenna mounted for horizontal polarization;

FIG. 2 is a perspective view of the invention mounted for vertical polarization;

DESCRIPTION OF THE PREFERRED EMBODIMENTS

Figures 3, 4, 5, 6, 7, 8, 9:
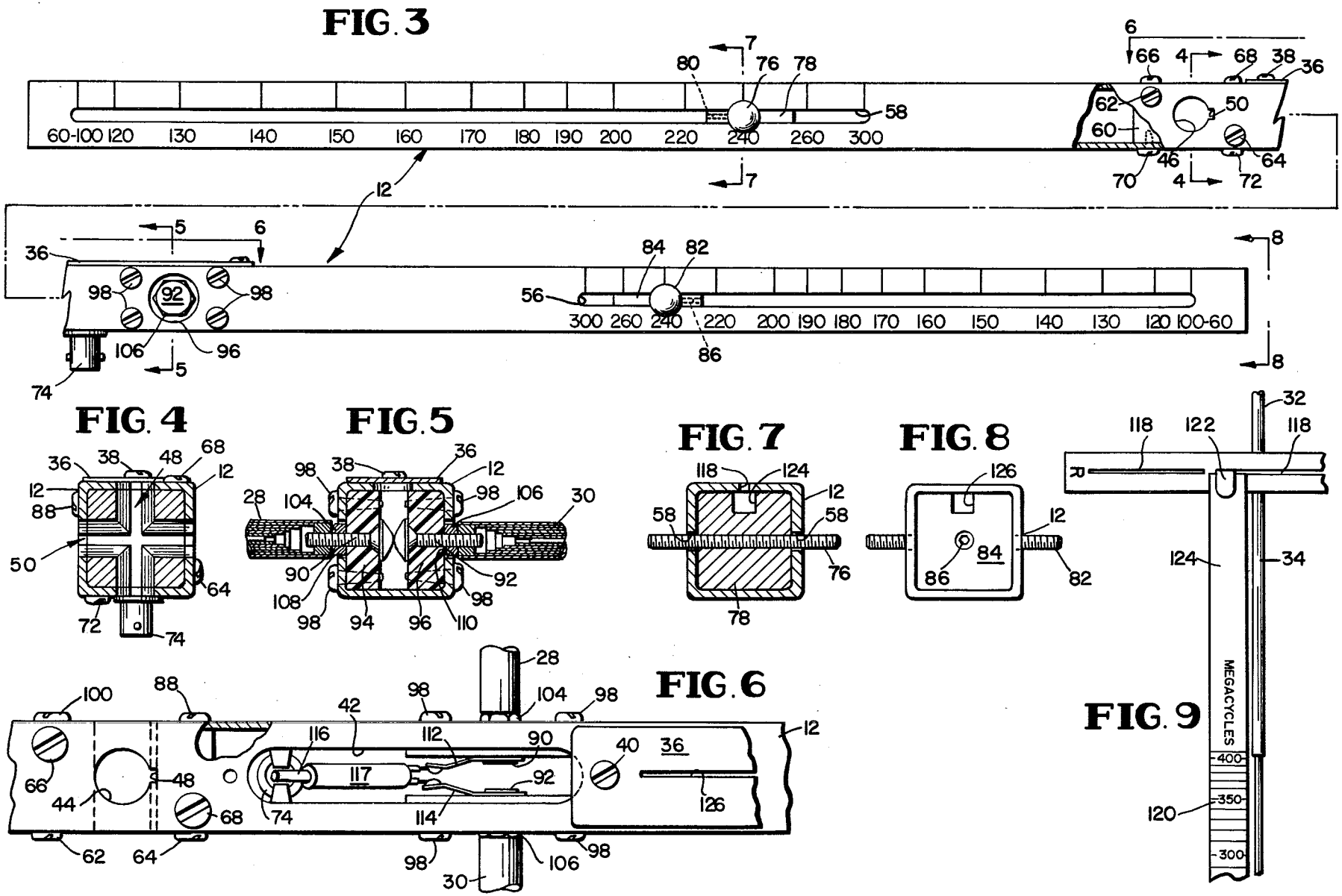
FIG. 3 is a cut side view of the invention.
FIG. 4 is a vertical cross section of the invention taken on line 4—4 of FIG. 3 looking in the direction of the arrows.
FIG. 5 is a vertical cross section of the invention taken on line 5—5 of FIG. 3 looking in the direction of the arrows.
FIG. 6 is a top plan view of the invention taken on line 6—6 of FIG. 3 with the housing partially removed looking in the direction of the arrows.
FIG. 7 is a cross sectional view of the invention taken on line 7—7 of FIG. 3 looking in the direction of the arrows.
FIG. 8 is an end view of the invention taken on the line 8—8 of FIG. 3 looking in the direction of the arrows.
FIG. 9 is a fragmentary top plan view illustrating the setting of an element of the invention.

FIG. 1, which illustrates the preferred embodiment of the invention, shows a perspective view of yagi antenna 10 mounted for horizontal polarization on mast 14. Yagi antenna 10 has an antenna boom 12 which is rectangular in shape and composed of aluminum, but the boom may be any geometrical shape such as circular and composed of any suitable material such as plastic, wood, etc. The antenna boom 12 is supported by a mast 14 which may be wood, metal, plastic, or any other suitable support material. A coaxial cable 16 is connected from yagi antenna 10 to a receiver or transmitter system. Attached to antenna boom 12 is a director element 18, a half-wave active dipole element 20, and a reflector element 22. Director element 18 is comprised of two 11-section telescoping element rods 24 and 26 where each section telescopes into the preceding section to a collapsible position. The telescoping element rod is similar to that found on small portable radios. Half-wave active dipole element 20 is comprised of two 11-section telescoping element rods 28 and 30. Reflector element 22 is comprised of two 11-section telescoping element rods 32 and 34. The number of sections in the telescoping element rods is not limiting as such depends on the overall length of each element rod for a particular operating frequency. A housing cover 36 is held on antenna boom 12 by two screws 38 and 40 which covers an inspection port 42 in FIG. 6. The top portion 42 of mast 12 is a machinable material such as aluminum which has been machined to the shape of mast hole 44 (FIG. 2) which is used to support the mast for horizontal polarization as in FIG. 1 and mast hole 46 which is used to support the mast in a vertical polarization configuration (FIG. 1). The top portion 42 of mast 12 has a rectangular protrusion (not shown) which fits into keyway 48 of mast hole 44 for horizontal polarization and into keyway 50 of mast hole 46 for vertical polarization. The tip 52 of top portion 42 of mast 14 is threaded so that a lock washer (not shown) and a nut or wingnut 54 of larger diameter than mast hole 44 can be tightened so as to securely affix antenna boom 12 to mast 14. Director element 18 is slidably adjustable along the reflector portion of antenna boom 12 in reflector slot. FIG. 2 shows a perspective view of yagi antenna 10 mounted in a vertical polarization configuration on mast 14. Mast hole 44 and keyway 48 are utilized when yagi antenna 10 is mounted in a horizontal polarization configuration. All other numerals correspond to the same components in FIG. 1. FIG. 3 is a cut side view of yagi antenna 10 wherein due to the overall length of antenna boom 12, it is illustrated on two lines. On the top line of FIG. 3, mast hole 46 and keyway 50 is illustrated which is used when yagi antenna 10 is in a vertical polarization mounting configuration on mast 14. Mast hole 46 and mast hole 44 (utilized for horizontal polarization and shown in FIG. 2) are machined at right angles on intersecting center lines into antenna boom 12 through mast support block 60. Mast support block 60 is of a slightly smaller dimension than rectangular antenna boom 12 in that it is positioned inside antenna boom 12 and fastened by screws or other suitable fastening means such as spot welding. Eight screws are used in fastening mast support block 60 to the inside of antenna boom 12, two screws on a diagonal line on each of the four sides of rectangular antenna boom 12. Screws 62, 64 (on a diagonal line), 66, 68, 70, 72, 88, and 100 are utilized. Housing cover 36 which covers inspection port 42 in FIG. 6 is affixed to antenna boom 12 by two screws 38 and 40. The reflector antenna element 22 has two 11-section telescoping reflector element rods 32 and 34 which are screwed onto each side of a threaded rod 76. Threaded rod 76 is securely screwed into and through a rectangular reflector sliding block 78 which loosely slides inside reflector slot 58 rectangular antenna boom 12 as slot 58 is slightly larger than threaded rod 76. Threaded rod 76 is held in place in reflector sliding block 78 by a hexagonal set screw 80. The length of slide of reflector sliding block 78 is determined by the length of reflector slot 58 which is symmetrical on two opposing faces of rectangular antenna boom 12. Threaded rod 76 protrudes out a distance (one-half inch or so) on each side of antenna boom 12 so that 11-section telescoping reflector element rods 32 and 34 comprising reflector element 22 can be screwed onto threaded rod 76. A BNC coaxial connector 74, on the second line of FIG. 3, is securely attached to antenna boom 12 by a lockwasher and nut on the inside of antenna boom 12 through inspection port 46. Coaxial cable 16 is connected to coaxial connector 74. Any suitable type of coaxial connector may be utilized in lieu of the BNC coaxial connector. The director element 18 has two 11-section telescoping director rods 24 and 26 which are screwed onto each side of a threaded rod 82. Threaded rod 82 is securely screwed into and through a rectangular director sliding block 84 which loosely slides inside slot 56 rectangular antenna boom 12, as slot 56 is slightly larger than threaded rod 82. The threaded rod 82 is held in place in director sliding block by a hexagonal set screw 86. The length of slide of director sliding block 84 is determined by the length of director slot 56 which is symmetrical on two opposing faces of rectangular antenna boom 12. The half-wave active dipole element 20 has two element rods 28 and 30 which are screwed onto flathead bolt 90 and 92 (shown in FIG. 3). Nut 106 secures bolt 92 to an insulating board 96. Hole 110 provides clearance between nut 106 and antenna boom 12. FIG. 4 shows a vertical cross section of the mast support block 60 taken on line 4—4 of FIG. 3 looking in the direction of the arrows showing the horizontal polarization keyway 48 and the vertical polarization keyway 50. The shaded portion on either side of keyway 48 is hole 44 utilized for horizontal polarization, and the shaded portion on either side of keyway 50 is hole 46 utilized for vertical polarization. Screws 68, 72, 74, and 88 are shown which affix the mast support block 60 to the rectangular antenna boom 12. The coaxial connector 74 is shown on the underside of antenna boom 12. Cover plate 36 with fastening screw 38 is shown on the top side of antenna boom 12. FIG. 5 is a vertical cross section of yagi antenna 10 taken on line 5—5 of FIG. 3 looking in the direction of the arrows inside rectangular antenna boom 12 which shows the half-wave active dipole antenna element rods 28 and 30 plus the associated support structure. The half-wave active dipole elements rods 28 and 30 are screwed onto flathead bolts 90 and 92. Blocks of suitable insulating material 94 and 96 such as G-16 fiberglass epoxy board are fastened to the opposing insides of the rectangular antenna boom 12 with four screws on each side of the four corners of the two blocks 94 and 96. Each screw is numeral 98 due to the symmetry. Flathead bolts 90 and 92 are threaded through the blocks 94 and 96 respectively and secured with nuts 104 and 106 which have ample clearance through holes 108 and 110 in antenna boom 12. Flathead bolts 90 and 92 are then insulated from the antenna boom 12 as the bolts 90 and 92 are mounted on blocks 94 and 96. Housing cover 36 and screw 38 are shown on the top side of antenna boom 12. FIG. 6 is a top plan view of yagi antenna 10 taken on line 6—6 of FIG. 3 with the housing cover 36 partially swung around screw 40 looking in the direction of the arrow; that is, down through and into the inspection port 42. Attached to flathead bolts 90 and 92 are spade solder lugs 112 and 114. Nuts 104 and 106 secure flathead bolts 90 and 92 to insulating blocks 94 and 96. Coax 116 inside the inspection port connects the coaxial connector 74 to the spade lugs 112 and 114 of the half-wave active dipole antenna elements rods 28 and 30. Coaxial cable 116 is passed through a ferrite core member 118, in this case Indiana General Q-1 having a permeability of 160, which acts as a balun. The coaxial cable 116 is slipped through a hole in the ferrite core member 118 which acts as a high impedance path for the return of radio frequency energy. This in effect floats the end of the coaxial cable 116 from yagi antenna 10 as rf energy can't return on the shield. The ferrite core member 118 chokes the energy thereby making the cable braid assume a voltage resulting in a balanced system as the coaxial cable assumes a differential voltage thereby stopping the return of rf energy past the ferrite core member. The Indiana General Q-1 is a low frequency ferrite having its choking efficiency increase with the frequency of operation. Any high permeability ferrite core material (such as from 100–3000) would be suitable and the invention is not limited to the use of Indiana General Q-1. Screws 62, 64, 66, 68, 88, and 100 attach mast support block 60 (not visible) to antenna boom 12 through which mast hole 44 and keyway 48 for a horizontal polarization configuration are machined. FIG. 7 is a cross sectional view of yagi antenna 10 taken on line 7—7 of FIG. 3 looking in the direction of the arrows. Rectangular antenna boom 12 has inserted into it reflector sliding block 78 with threaded rod 76 protruding through reflector slot 58. A top slot 118 is provided so that the tip 122 of Megacycle Rule 120 (FIG. 9) can be inserted into the antenna boom 12 for setting the element rod length. A rectangular indentation 124 is cut onto the top center portion of sliding block 78 so that tip 122 of the Megacycle Rule 120 can be inserted down through top slot 118 into indentation 124 eliminating the need for a "third hand." The director sliding block 84 is identical to reflector sliding block 78 in that it is provided with an identical indentation. FIG. 8 is an end view of yagi antenna 10 taken on line 8—8 of FIG. 3 looking in the direction of the arrows showing director sliding block 84 inside of the rectangular antenna boom 12 and hexagonal set screw 86 which is threaded into director sliding block 84 so as to securely fasten threaded rod 56 into block 84. Indentation 126 in director sliding block 84 accommodates tip 122 of Megacycle Rule 120.

PREFERRED MODE OF OPERATION

To assemble yagi antenna 10 for receiving or transmitting, the antenna boom 12, mast 14, coax 16, and six 11-section telescoping antenna element rods are removed from a suitable portable storage case (not shown for purposes of illustration). Two 11-section telescoping antenna element rods in a collapsible untelescoped state are screwed securely "finger tight" onto flathead bolts 90 and 92 which comprise the half-wave active dipole element rods 28 and 30. The remaining four 11-section telescoping antenna element rods in a collapsible untelescoped state are loosely screwed onto the threaded rods 82 and 76 of the director element 24 and reflector element 32 respectively. FIGS. 1 and 3 illustrate inscribed marks of frequency of operation on the side of antenna boom 12. By way of example in FIG. 1, inscribed mark "240" inscribed into antenna boom 12 refers that the reflector and director elements are positioned on the antenna boom for operation at a predetermined frequency of 240 MHz. Once the frequency of operation has been predetermined and with reference made to FIG. 3, director sliding block 82 is slid to position with threaded rod 82 being positioned above the inscribed mark on the antenna boom 12 for the predetermined frequency of operation. The eleven section telescoping director element rods 24 and 26 are then securely screwed onto the threaded rod 82 so that the overlapping end portions of the rods snug firmly up against antenna boom 12 with a friction tight fit. The 11-section telescoping antenna element rods are then firmly attached to threaded rod 82 of director sliding block 84 and lock the director sliding block 84 against the boom by friction. The same procedure is followed by loosely screwing the last two 11-section telescoping antenna element rods onto threaded rod 76 of reflector sliding block 78 comprising the reflector element. Then, the reflector sliding block 78 is slid to the predetermined frequency position of the appropriate inscribed mark, and the reflector element rods 32 and 34 are securely fastened with a friction tight fit to lock through friction reflector sliding block 78 against antenna boom 12. The length of the antenna rod elements is set by utilizing a Megahertz Rule, 120 as shown in FIG. 9, similar to a tape measure but instead of being marked in inches, is marked in megahertz as illustrated on the tape portion 124 of megahertz rule 120. The predetermined length of the half-wave active dipole element rods 28 and 30 is set by pulling outward on the beads of the 11-section telescoping element rod to the predetermined frequency optimum position as marked on the tape portion 124 of the megahertz rule 120. The tip end 122 of the Megahertz Rule 120 has been previously inserted into slot 126 on housing cover 36 so as to eliminate the need for a "third hand." The length of the director element rods 24 and 26 are set to the predetermined operating frequency by making each director element rod length 10% shorter than each half-wave active dipole element rod length. This is accomplished by subtracting 10% of the predetermined frequency of operation from the frequency of operation on the tape portion 124 of the megahertz rule 120, and using this low frequency value to set each director element rod length. The length of reflector element rods 32 and 34 is set to the predetermined operating frequency by making each reflector element rod 32 and 34 length 10% longer than each half-wave dipole element 18. This is accomplished by adding 10% of the predetermined frequency to the operational frequency and using the higher frequency to set each reflector element length. The antenna boom 12 is then mounted on mast 14 with top portion 42 being inserted into either mast hole 44 for horizontal polarization or mast hole 46 for vertical polarization. Coaxial cable 16 is connected to coaxial connector 74 and to a receiving or transmitting system. Yagi antenna 10 is taken apart for storage in the reverse order of steps.

Various modifications are contemplated and may obviously be resorted to by those skilled in the art without departing from the spirit and scope of the invention, as hereinafter defined by the appended claims as a preferred embodiment thereof has been disclosed. For instance, the length of the boom could be extended so that there could be either two or more director or reflector elements. The telescopic whip antenna element rods could be composed of any number of sections instead of the disclosed eleven. The ferrite core material could have any suitable permeability from 100 to 3000. A folded half-wave active dipole element could be used in lieu of the half-wave active dipole along with a suitable balun for matching for and by way of example from 300 to 75 ohm.

What is claimed and desired to be secured by Letters Patents of the United States is:

1. A yagi antenna comprising a rectangular antenna boom slotted on opposed faces with director and reflector elements coupled to slideable block within said boom through said slots, with half-wave active dipole element affixed to said boom with two insulated blocks on opposed faces and all said director, reflector, and active elements are adjustable in length and the said director and reflector elements are adjustable in spacing with respect to the active element.

2. The yagi antenna of claim 1 wherein said director and reflector elements are affixed to said boom by means of threaded member secured to said slidable block within the boom and said threaded member extending through said slots.

* * * * *